United States Patent [19]

Röck

[11] 4,367,906

[45] Jan. 11, 1983

[54] PULL-OUT GUIDE FOR DRAWERS

[75] Inventor: Erich Röck, Höchst, Austria

[73] Assignee: Julius Blum Gesellschaft m.b.H., Höchst, Austria

[21] Appl. No.: 188,601

[22] Filed: Sep. 18, 1980

[30] Foreign Application Priority Data

Sep. 27, 1979 [AT] Austria ..... 6330/79

[51] Int. Cl.[3] ..... F16C 21/00

[52] U.S. Cl. ..... 312/330 R; 312/341 R; 312/348; 308/3.8

[58] Field of Search ..... 312/330 R, 332, 333, 312/334, 335, 336, 337, 338, 339, 340, 341 R, 348; 308/3.8

[56] References Cited

U.S. PATENT DOCUMENTS

| | | | |
|---|---|---|---|
| 1,454,494 | 5/1923 | Thomas | 312/337 |
| 1,994,424 | 3/1935 | Brantingson | 312/340 |
| 2,747,943 | 5/1956 | Metcalf | 308/3.8 |
| 3,679,274 | 7/1972 | Nance | 312/341 NR |
| 3,702,179 | 11/1972 | Radke et al. | 308/3.8 |
| 4,037,885 | 7/1977 | Rock et al. | 308/3.8 |
| 4,176,890 | 12/1979 | Gorton | 312/341 R |
| 4,196,943 | 4/1980 | Rock et al. | 308/3.8 |

*Primary Examiner*—Victor N. Sakran

*Attorney, Agent, or Firm*—Wenderoth, Lind & Ponack

[57] ABSTRACT

A pull out guide assembly for drawers includes a pull out rail on each side of the drawer and a supporting rail on each side wall of a cabinet or the like. Rollers run between each pull out rail and supporting rail. The rollers are held in a floating carriage. The carriage extends horizontally and not vertically in the operating position and the rollers that embrace the supporting rail are situated laterally of each other and not above each other.

6 Claims, 3 Drawing Figures

PULL-OUT GUIDE FOR DRAWERS

BACKGROUND OF THE INVENTION

1. Field of the Invention

The present invention relates to a guide rail assembly, particularly for drawers, with one pull-out rail on the side of the drawer and one supporting rail on the side of the body of a piece of furniture, on either side of the drawer, the load of the drawer being transferred by means of rollers or the like mounted in a carriage, the rollers of the carriage running on both sides of each supporting rail associated therewith.

2. Description of the Prior Art

Such guide rail assemblies are widely used in modern furniture construction, particularly in the construction of kitchen and office furniture.

It is their take to facilitate the moving of drawers or shelves, and to prevent them from tilting, when they are pulled out.

In addition to the afore-mentioned tasks, pull-out guide assemblies should fulfil a further requirement. They should not or only slightly restrict the space inside the drawer, i.e. they should occupy only a minimum space in the direction of the breadth of the drawer.

It has further proved advantageous to adapt the roller carriage to be covered by the drawer side wall, thus protecting the assembly from dirt and dust. This provision has aesthetic advantages and, furthermore, ensures a long service life of the guide rail assembly.

It is well known to make the side walls of the drawer of plastics material, e.g. by means of extrusion. It is further known to insert the pull-out rails of the guide assembly and the carriages into the side wall of the drawer and to cover the carriages towards the outside by means of a covering flap.

Due to the rising prices in the field of plastics materials, conventional materials have frequently been used again in order to save costs. Drawer side walls are, therefore, again often made of wood or chip board material.

It is technically possible to arrange the pull-out rail and the carriage in the side walls of such drawers. The manufacture of such drawers is complicated, however, and this kind of construction may effect a marked weakening of the drawer side wall.

The covered arrangement of the pull-out rails and of the carriage is also difficult and causes high costs.

SUMMARY OF THE INVENTION

It is, therefore, the object of the present invention to provide a guide rail assembly, particularly for drawers, in which the pull-out rails as well as the carriages can be covered even when employed in drawers whose side walls are made of wood or chip board material. The carriage and all rails of the guide rail assembly should be arranged in such a manner that no space is lost inside the drawer.

In accordance with the present invention this is achieved by arranging the supporting rollers receiving the supporting rail adjacent to one another in the carriage and to lie substantially in a horizontal plane, the running flange of the supporting rail having a center flange being vertically aligned and the rollers lying adjacent to different horizontal flanges extending from the center flange.

It is preferably provided that the diameters of the rollers staggeredly arranged in the direction of the breadth of the drawer are different from one another.

A particularly smooth running of the drawer is obtained by providing compensating rollers arranged normally to the supporting roller, such compensating rollers running on the center flange of the supporting rail and being positioned on the side of the free rim of the supporting rail.

BRIEF DESCRIPTION OF THE DRAWINGS

In the following the invention will be described in greater detail with reference to the accompanying drawings, without being limited thereto, and wherein.

DESCRIPTION OF THE PREFERRED EMBODIMENT

Figure 1:
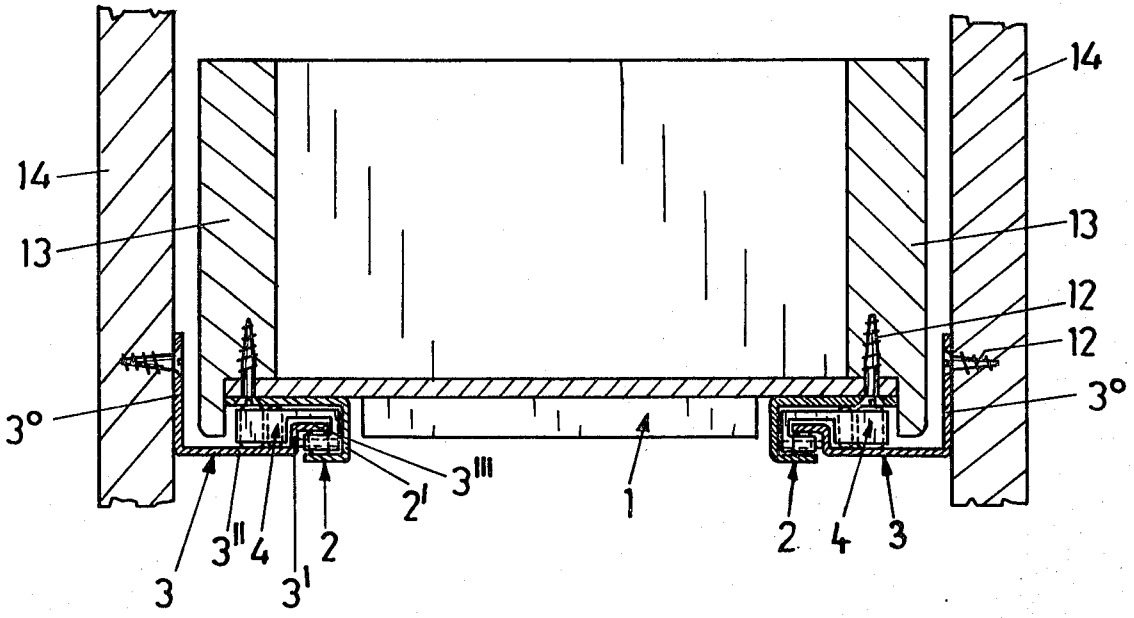
FIG. 1 is a vertical sectional view of a drawer with a guide rail assembly in accordance with the present invention.
Figure 2:
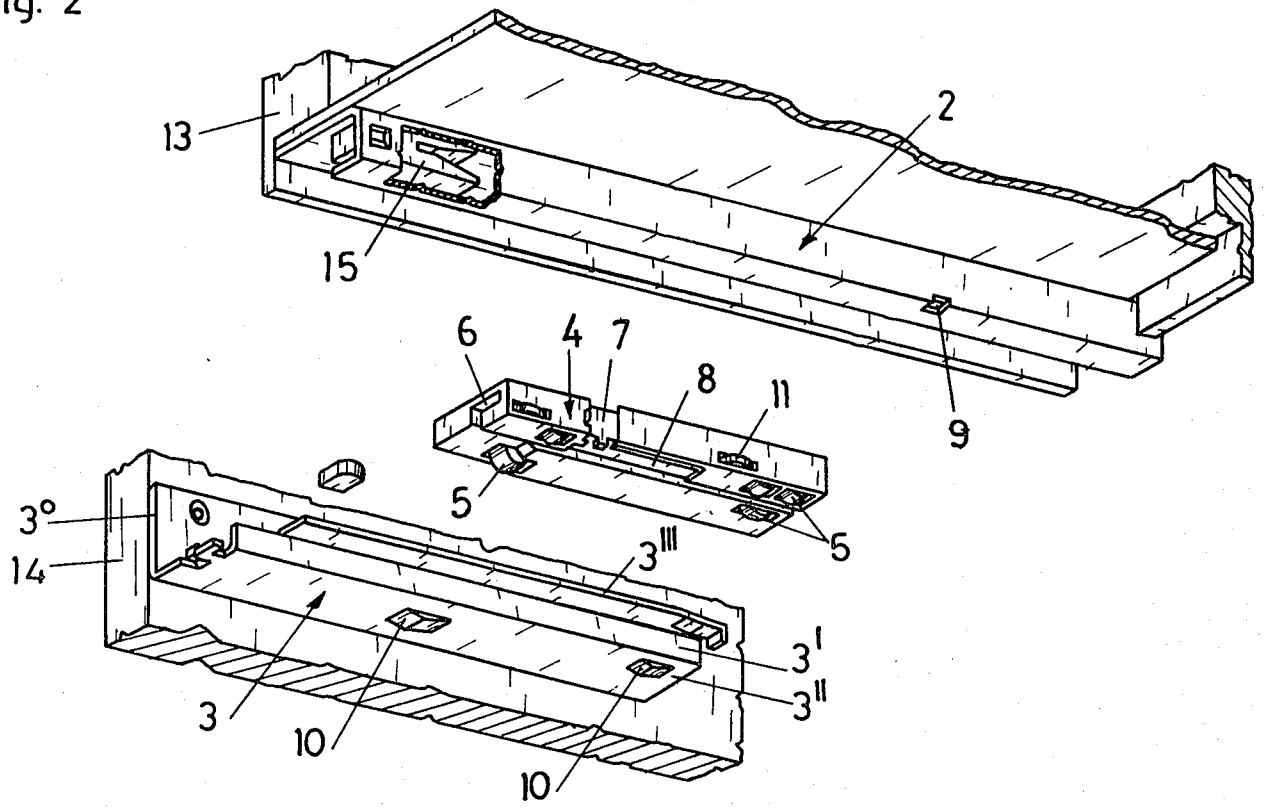
FIG. 2 is an exploded perspective view of the essential parts of the guide rail assembly, i.e. the pull-out rail on the side of the drawer, the carriage and the supporting rail on the side of the body.

The guide rail assembly in accordance with the present invention comprises in a conventional manner on each side of the drawer a pull-out rail 2 on the side of the drawer and a supporting rail 3 on the side of the body. A carriage 4 is arranged between the supporting rail 3 and the pull-out rail 2.

It is the essential characteristic of the present invention that the carriage 4 is lying and not standing, i.e. the rollers 5 arranged on both sides of the center flange 3' of the running flange of the supporting rail 3 are not situated above each other but laterally of each other. The rollers 5 rest on both sides of the supporting rail 3 as in the case of conventional guide rail assemblies. They rest first above the horizontal flange 3'' and, second, below the horizontal flange 3''' of the supporting rail 3.

The carriage 4 has an L-shaped recess 6 in which the horizontal flange 3''' and the vertical flange 3' of the supporting rail 3 are inserted.

Figure 3:
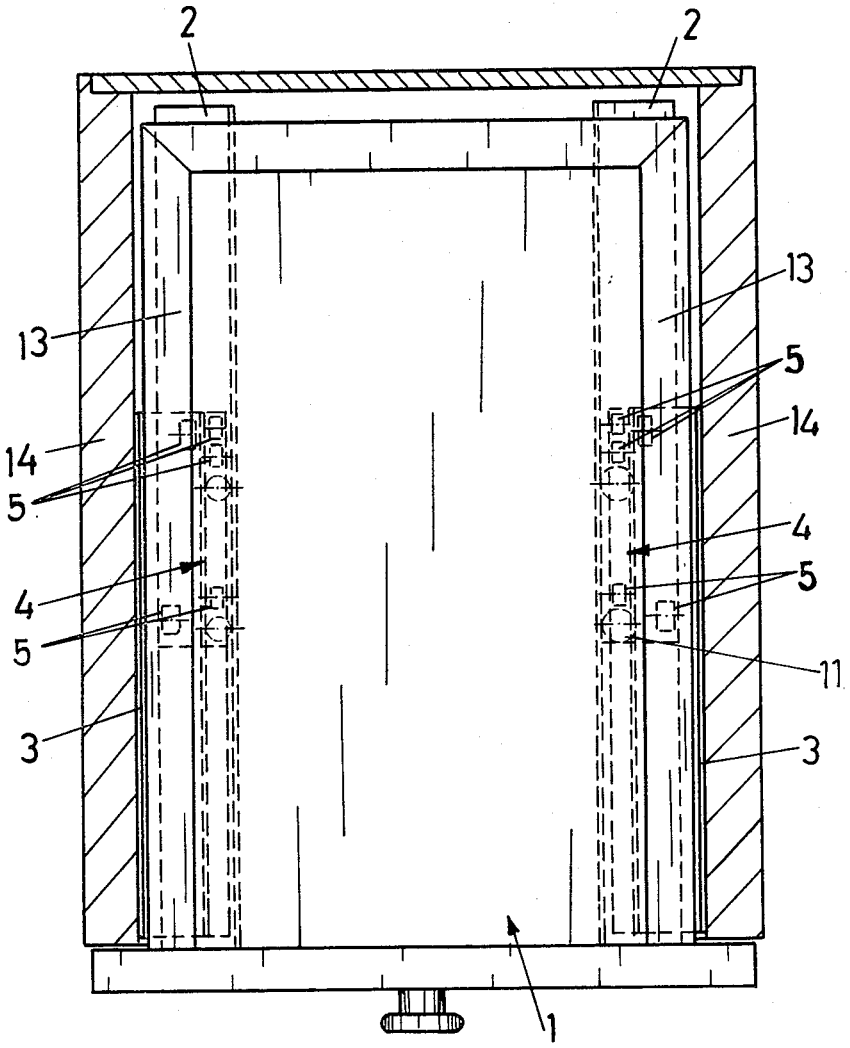
FIG. 3 is a top view of a guide rail assembly in accordance with the present invention, particularly illustrating the geometry of the rollers.

As can be seen in FIGS. 1 and 3, the rollers 5 are of different diameters and breadths. As can be seen in FIG. 3, the rollers 5 running on the horizontal flange 3'' of supporting rail 3 are arranged in a staggered manner in the direction of the breadth of the drawer.

For locking the drawer 1 in the pulled-out position the carriage 4 is provided with a slide 7 acted upon by a spring 8 and engaging in a recess 9 of the pull-out rail 2, when the drawer is in the pulled-out position.

The supporting rail 3 is provided with retaining members 10 forming recesses in the running face for the rollers 5 in order to prevent the drawer 1 from rolling out of the body unintentionally.

The carriage 4 is further provided with compensating rollers 11 running between the vertical flange 3' of the supporting rail and the center flange 2' of the pull-out rail 2 and laterally guiding the drawer.

The pull-out rails 2 are fastened to the drawer side wall 13 below the bottom of the drawer by means of conventional fastening means, e.g. by means of screws 12.

The supporting rails 3 have a fastening flange 3° which is screwed to the side wall 14 of the body by means of screws 12.

The pull-out rails 2 may at their front ends be provided with a stop 15 which can be adapted to be height-adjustable.

As the guide rail assembly in accordance with the present invention is arranged in a lying position or horizontal orientation and below the bottom of the drawer no space at all is lost in the direction of the breadth of the drawer 1 and only little space is employed in the direction of the height of the drawer 1, thus ensuring that the space of the drawer can be used to an optimum extent. Moreover, the pull-out rails 2 and the carriages 4 are also covered when the drawer 1 has been pulled out of the body. The carriage 4, the compensating rollers 11 and the rollers 5 are preferably injection-moulded of plastics material.

What is claimed is:

1. A guide assembly for use on each of opposite sides of a drawer in an article of furniture of the type wherein the drawer is slidably insertable into and removable from a furniture body, said assembly comprising:

a pull-out rail adapted to be mounted on the bottom of a drawer;

a supporting rail adapted to be mounted on a side portion of an article of furniture, said supporting rail including a vertical flange and first and second horizontal flanges extending from opposite sides of said vertical flange;

means for transferring the load of the drawer to the article of furniture, said means comprising a roller carriage mounted between said pull-out and supporting rails and carrying a plurality of supporting rollers arranged laterally of each other and lying substantially in a horizontal plane;

said plurality of rollers including first rollers positioned laterally of a first side of said vertical flange and contacting said first horizontal flange at a first surface of said supporting rail; and said plurality of rollers further including second rollers positioned laterally of a second side of said vertical flange and resting adjacent said second horizontal flange at a second surface of said supporting rail.

2. An assembly as claimed in claim 1, wherein said plurality of rollers are arranged in a laterally staggered manner.

3. An assembly as claimed in claim 1, wherein said first rollers are arranged in a laterally staggered manner.

4. An assembly as claimed in claim 1, wherein said first rollers each have a diameter different from the diameter of said second rollers.

5. An assembly as claimed in claim 1, wherein said pull-out rail includes first and second, vertically spaced, horizontal flanges, said first rollers run between an upper surface of said first horizontal flange of said supporting rail and a lower surface of said first horizontal flange of said pull-out rail, and said second rollers run between a lower surface of said second horizontal flange of said supporting rail and an upper surface of said second horizontal flange of said pull-out rail.

6. An assembly as claimed in claim 1, wherein said pull-out rail includes a vertical flange, and said roller carriage further carries compensating rollers running on said vertical flange of said supporting rail and said vertical flange of said pull-out rail.

* * * * *